US005303014A

United States Patent [19]

Yu et al.

[11] Patent Number: 5,303,014

[45] Date of Patent: Apr. 12, 1994

[54] BIASABLE MEMBER HAVING LOW SURFACE ENERGY

[75] Inventors: Zhao-Zhi Yu, Webster; Daniel E. Kuhman, Fairport, both of N.Y.

[73] Assignee: Xerox Corporation, Stamford, Conn.

[21] Appl. No.: 979,683

[22] Filed: Nov. 20, 1992

[51] Int. Cl.[5] ..... G03G 15/14

[52] U.S. Cl. ..... 355/273; 355/271

[58] Field of Search ..... 355/271, 273, 277, 296; 430/48; 428/357, 364, 375, 396, 400

[56] References Cited

U.S. PATENT DOCUMENTS

| | | | |
|---|---|---|---|
| 3,847,119 | 11/1974 | Hoffman et al. | 355/271 X |
| 4,309,803 | 1/1982 | Blaszak | 355/271 X |
| 4,977,430 | 12/1990 | Florack et al. | 355/277 X |
| 5,010,370 | 4/1991 | Araya et al. | 355/271 X |
| 5,011,739 | 4/1991 | Nielsen et al. | 428/425.8 |
| 5,038,178 | 8/1991 | Hosoya et al. | 355/277 |
| 5,073,434 | 12/1991 | Frank et al. | 428/195 |
| 5,101,238 | 3/1992 | Creveling et al. | 355/271 |
| 5,150,165 | 9/1992 | Asai | 355/271 X |
| 5,153,618 | 10/1992 | Frank et al. | 346/159 |
| 5,159,393 | 10/1992 | Hiroshima et al. | 355/277 |

OTHER PUBLICATIONS

U.S. patent application Ser. No. 07/937,322; Lindblad et al; filed: Aug. 31, 1992.

*Primary Examiner*—A. T. Grimley
*Assistant Examiner*—Sandra L. Brasé
*Attorney, Agent, or Firm*—Denis A. Robitaille

[57] ABSTRACT

A bias transfer member including a peripheral surface having low surface energy is disclosed. The low surface energy provides improved cleanability for enhancing the electrostatographic process and increasing the life of the bias transfer member. A low surface energy layer is provided by plasma fluorination to chemically modify the makeup of the surface material or by coating to form a low surface energy layer on the bias transfer member.

11 Claims, 3 Drawing Sheets

BIASABLE MEMBER HAVING LOW SURFACE ENERGY

The present invention relates generally to an apparatus for transfer of charged toner particles in an electrostatographic printing machine, and more particularly, concerns an electrically biasable transfer member having low surface energy for enhancing the cleanability thereof.

Generally, the process of electrostatographic copying is executed by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface thereof. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

The operation of transferring developing material from the photoreceptive member to the image support substrate is realized at a transfer station. In a conventional transfer station, transfer is achieved by applying electrostatic force fields in a transfer region sufficient to overcome forces holding the toner particles to the surface of the photoreceptive member. These electrostatic force fields operate to attract and transfer the toner particles over onto the copy sheet or other image support substrate. Typically, transfer of toner images between support surfaces is accomplished via electrostatic induction using a corotron or other corona generating device. In such corona induced transfer systems, the surface of the image support substrate is placed in direct contact with the toner image while the image is supported on the photoreceptive member. Transfer is induced by "spraying" the back of the support substrate with a corona discharge having a polarity opposite that of the toner particles, thereby electrostatically transferring the toner particles to the sheet. An exemplary corotron ion emission transfer system is disclosed in U.S. Pat. No. 2,836,725.

Toner transfer has also been accomplished successfully via biased roll transfer systems. This type of transfer apparatus was first disclosed by Fitch in U.S. Pat. No. 2,807,233, which disclosed the use of a metal roll coated with a resilient coating having an approximate resistivity of at least $10^6$ ohm-cm, providing a means for controlling the magnetic and non-magnetic forces acting on the toner particles during the transfer process. One shortcoming in such biased roll transfer systems arises from the resistivity of the resilient coating which introduces a limit to the amount of electrical bias that can be applied to the roll due to the fact that, at higher ranges, the air in and about the transfer zone begins to break down, or "ionize", causing image degradation during transfer. Nonetheless, bias roll transfer has become the transfer method of choice in many state-of-the-art xerographic copying systems and apparatus. Notable examples of biased roll transfer systems are described in U.S. Pat. No. 3,702,482 by C. Dolcimascolo et al., and U.S. Pat. No. 3,781,105, issued to T. Meagher. Other general examples of biased roll transfer systems can be found in U.S. Pat. Nos. 3,043,684; 3,267,840; 3,328,193; 3,598,580; 3,625,146; 3,630,591; 3,684,364; 3,691,993; 3,832,055; and 3,847,478, among others.

As described, the process of transferring development materials via a biased roll transfer system in an electrostatographic apparatus involves the physical detachment and transfer-over of charged particulate toner material from a first image support surface into attachment with a second image support surface under the influence of electrostatic force fields generated by a bias transfer roll. However, during the transfer process, some toner particles may become airborne or may otherwise break away from either of the support surfaces and come to rest on the surface of the bias transfer roll. These stray toner particles can become embedded in the transfer roll, can be retransferred to the backside of a sheet of paper, or can otherwise contaminate the reproduction process. Thus, during the transfer process, it has become necessary to clean the surface of the bias transfer roll in order to remove any toner particles therefrom. This cleaning operation must be accomplished rapidly and thoroughly, yet without damage to the surface of the bias transfer roll.

The residual toner particles retained on the surface of the bias transfer roll are often difficult to purge or remove. In order to cleanse the toner particles from the surface, a cleaning force must overcome the adhesion force between toner particles and the surface of the bias transfer roll. This adhesion force is believed to be made up of two components: the electrical charge attraction; and the Van der Waals' forces, those forces created by intermolecular attraction between the particles and the bias transfer roll. The present invention is directed towards reducing or eliminating the Van der Waals' forces to reduce the adhesion force acting on the toner particles so that the bias transfer roll can be more easily cleaned.

Conventional bias transfer roll systems have recognized the need for cleaning of the bias transfer roll. A typical cleaning device includes a brush or blade-type contact cleaning apparatus, or a vacuum or air knife-type non-contact cleaning apparatus. For example, a brush type cleaning system comprised of one or more rotating brushes which frictionally sweep toner particles off of the bias transfer roll surface by a mechanical wiping or brushing action. An exemplary brush-type cleaning apparatus used in combination with a bias transfer roll is disclosed in U.S. Pat. No. 3,781,105.

Other cleaning apparatus known in the art may include at least some combination of an air current and a brush cleaner which may be electrostatically charged, as disclosed, for example, in U.S. Ser. No. 07/937,322, of common assignee.

Although brush and other cleaning systems have been commercially successful, a major problem exists in long term usage of such cleaning systems due to the tendency of the brush (or other cleaning member) to itself become contaminated with toner particles. This ancillary contamination can result in both decreased cleaning efficiency as well as undesirable smearing of the toner particles on the bias transfer roll or other contacting member surface. Likewise, air cleaning systems tend to operate with less efficiency, such that some residual toner inherently remains on the transfer roll. Various approaches and solutions to the problems associated with the use of bias transfer rolls and specifically directed toward the problem of cleaning bias transfer rolls have been proposed. The following disclosures may be relevant to various aspects of the present invention:

U.S. Pat. No. 5,011,739; Patentee: Nielson et al.; Issued: Apr. 30, 1991.

U.S. patent application Ser. No. 07/937,322; Inventor: Lindblad et al.; Filed: Aug. 31, 1992.

The relevant portions of the foregoing disclosures may be briefly summarized as follows:

U.S. Pat. No. 5,011,739 discloses moisture stable biasable transfer members and methods for making the same wherein rolls, belts and other biasable members are provided having at least one layer or coating of an elastomeric resilient cross-linked polyurethane. A conductivity control agent is included in the cross-linked polyurethane elastomer for controlling the resistivity thereof and further to reduce the sensitivity of the resistivity of the polyurethane coating on the biasable member to changes in relative humidity.

U.S. patent application Ser. No. 07/937,322 discloses a cleaning device for removing residual toner and debris from the surface of a biased transfer roll including a cleaner housing mounted adjacent to the bias transfer roll having flexible conductive shims mounted on opposite sides of a vacuum chamber air inlet. The shims flutter during operation as a result of airflow through the air inlet, thereby causing the shims to lightly contact the toner surface while remaining substantially contactless with the bias transfer roll surface, to remove the toner from the roll surface.

In accordance with the present invention a transfer member for transferring electrically charged particles from an image support surface to a copy substrate is provided, wherein the transfer member comprises an electrically conductive core member, a first layer of resistive material covering the core member, and a peripheral surface having a sufficient amount of low surface energy material so as to provide the peripheral surface with low surface energy.

In accordance with another aspect of the invention, a biased roll transfer system for transferring electrically charged particles from an image support surface to a copy substrate is provided, comprising a transfer member including an electrically conductive core member, a first layer of resistive material coated on the core member, and a peripheral surface positioned adjacent the image support surface, wherein the peripheral surface has a sufficient amount of low surface energy material so as to provide the peripheral surface with low surface energy. The biased roll transfer system further includes means, coupled to the transfer member, for applying an electrical bias thereto to generate electrical fields between the transfer member and the image support surface and means for cleaning the transfer member.

In yet another aspect of the invention, there is provided an electrostatographic printing machine, comprising a biased roll transfer system for transferring electrically charged particles from an image support surface to a copy substrate, wherein the transfer system includes a transfer member including an electrically conductive core member, a first layer of resistive material coated on the core member and a peripheral surface positioned adjacent the image support surface, the peripheral surface having a sufficient amount of low surface energy material so as to provide the peripheral surface with low surface energy. The transfer system further includes means, coupled to the transfer member, for applying an electrical bias thereto to generate electrical fields between said transfer member and the image support surface, and means for cleaning the transfer member.

In another aspect of the invention, an electrostatographic printing apparatus is disclosed, including a transfer assembly for transferring toner particles from a photoconductive image support surface to a copy support substrate, wherein the transfer assembly includes a biasable transfer member having a low surface energy layer deposited thereon.

These and other aspects of the present invention will become apparent from the following description in conjunction with the accompanying drawings, in which.

Figure 1:
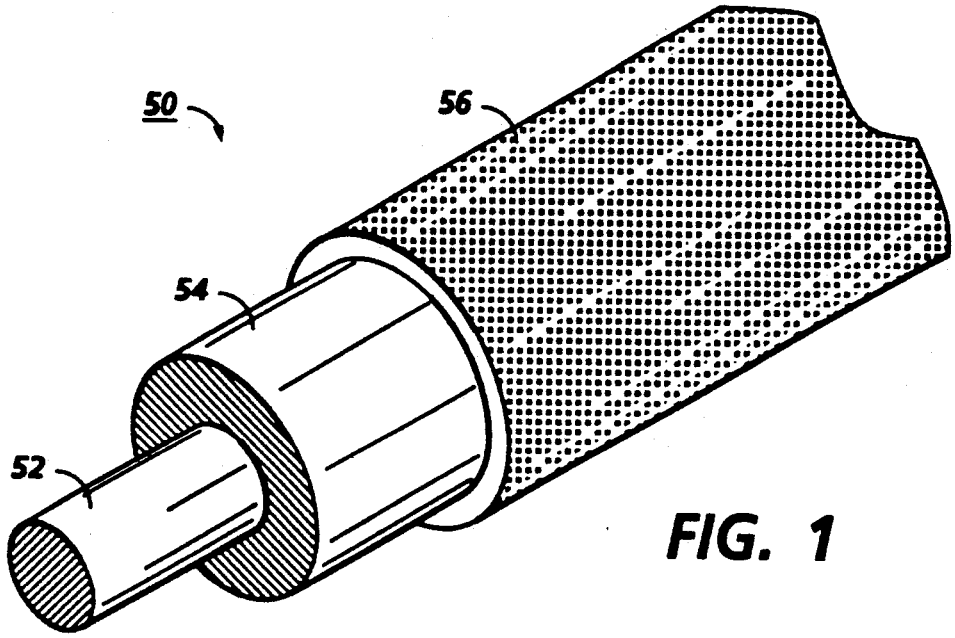
FIG. 1 is a perspective view in partial section showing the construction of one preferred embodiment of a bias transfer roll having an external surface with low surface energy in accordance with the present invention.

While the present invention will be described with reference to preferred embodiments thereof, it will understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout the Figures to designate identical elements.

Figure 3:
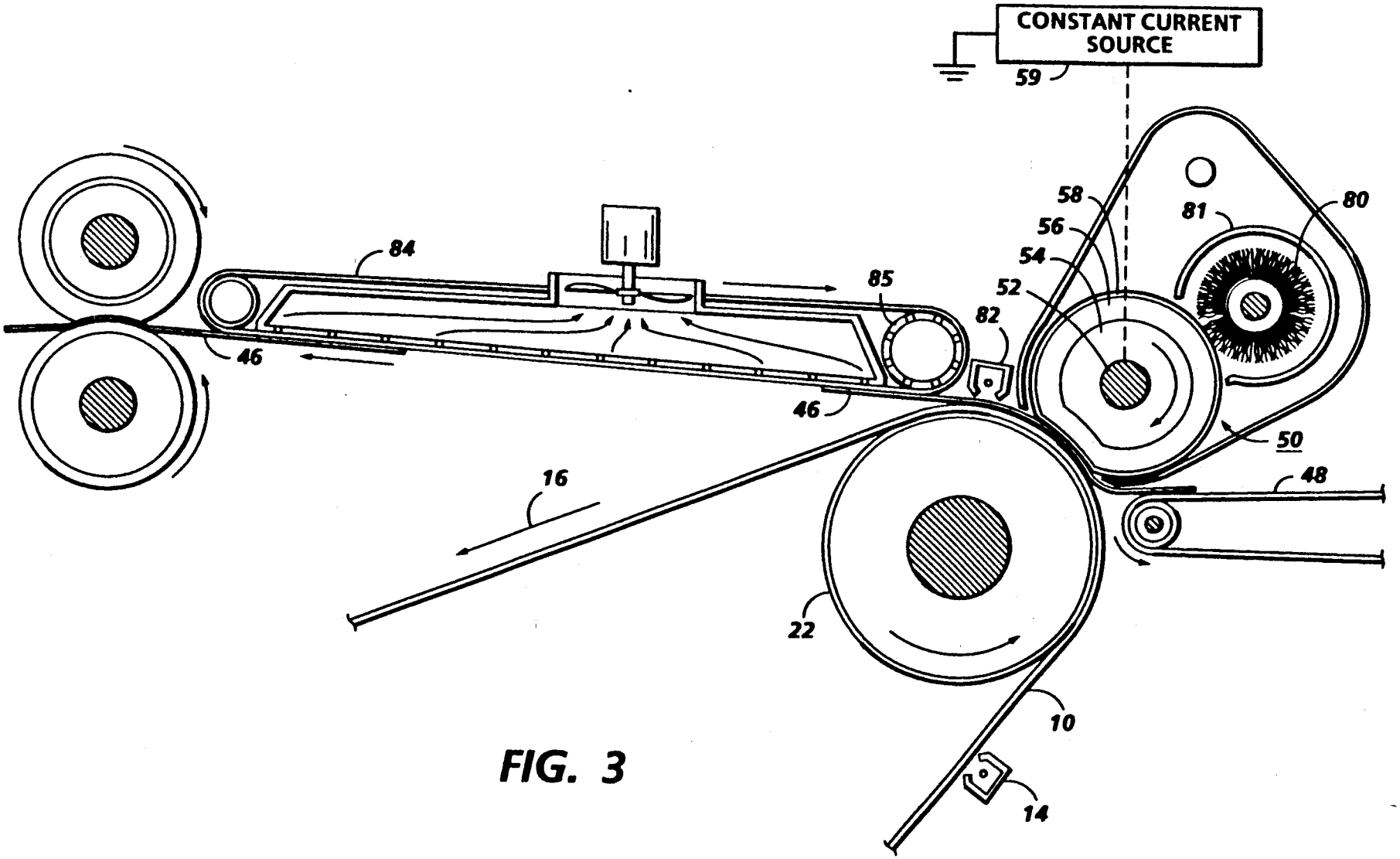
FIG. 3 is a schematic side view of an exemplary biased roll transfer system employing the features of the present invention in combination with a brush-type contact cleaning apparatus.
Figure 4:
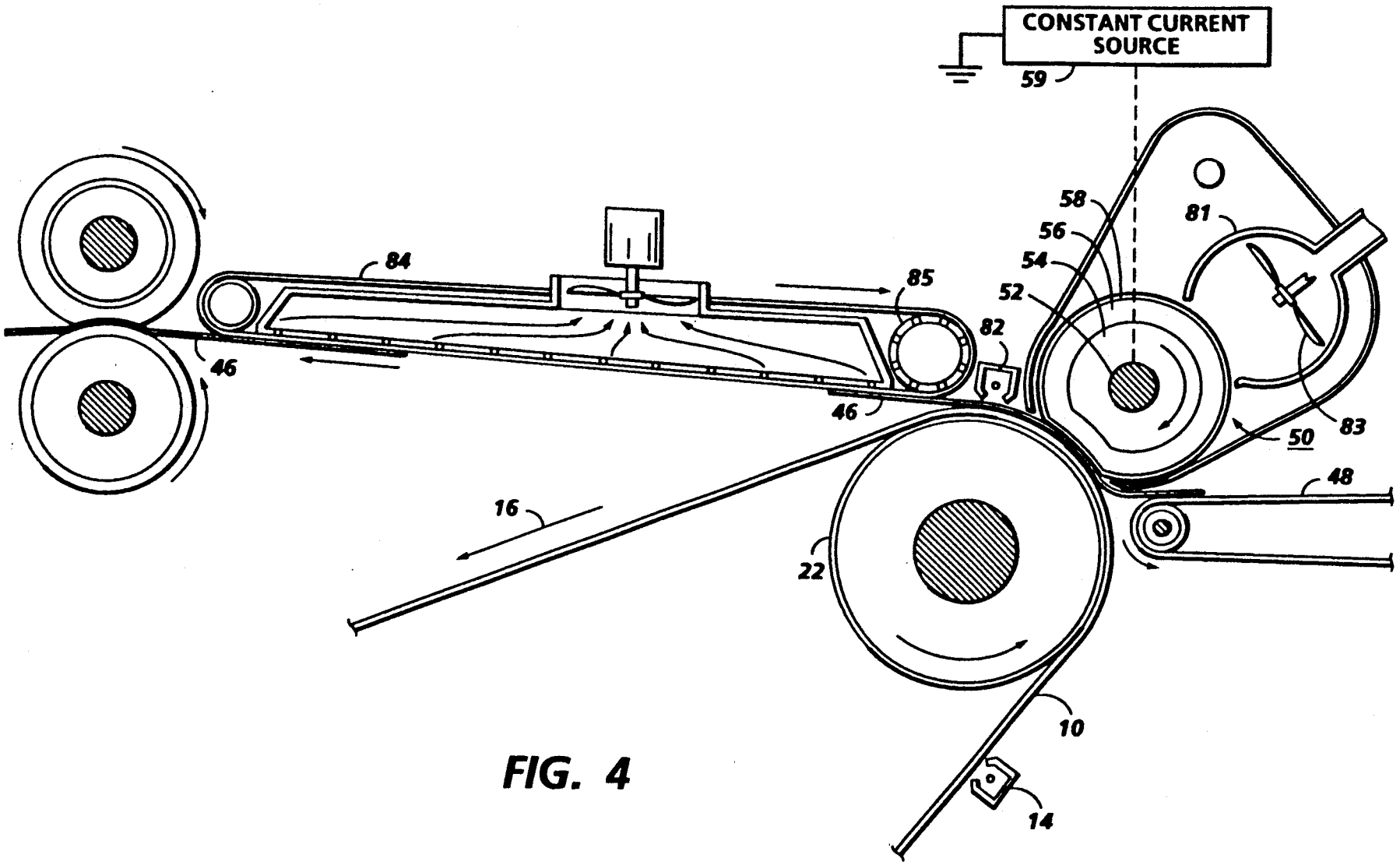
FIG. 4 is a schematic side view of an alternative embodiment of the exemplary biased roll transfer system of FIG. 3, wherein the cleaning apparatus is a vacuum type non-contact cleaning apparatus.

For a general understanding of an electrostatographic printing machine in which the features of the present invention may be incorporated, reference is initially made to FIGS. 3 and 4, prior to presenting a discussion of the specific features of the present invention, wherein a schematic depiction of the various components of an exemplary biased roll transfer system incorporating the biasable transfer roll member of the present invention is provided. Although the apparatus of the present invention is particularly well adapted for use in an automatic electrophotographic reproducing machine as shown, it will become apparent from the following discussion that the present transfer assembly is equally well-suited for use in a wide variety of electrostatographic processing machines as well as in any other system utilizing a biasable contact electrode or member. Further, the invention is not necessarily limited in its application to the particular embodiment or embodiments shown herein.

The exemplary transfer system of FIGS. 3 and 4 may be used in an electrophotographic printing machine that employs a belt 10 including a photoconductive surface deposited on an electrically grounded conductive substrate. Drive roller 22, which may be coupled to a motor by any suitable means, as for example via a drive belt, engages belt 10 for transporting the belt 10 about a curvilinear path in the direction of arrow 16, to advance successive portions thereof through the various processing stations of the electrostatographic machine disposed about the path of movement of the belt 10.

As previously described, and as is well known in the art, a segment of the photoconductive surface of belt 10 is initially charged to a relatively high, substantially uniform potential. Once charged, a light image is transmitted onto the charged portion of the photoconductive surface for selectively dissipating the charge thereon to record an electrostatic latent image on the belt 10. Belt 10 is then advanced to a development station where toner particles are deposited onto the electrostatic latent image for development thereof. Thereafter, belt 10 advances the developed image to a transfer station, as for example the exemplary transfer station of FIGS. 3 and 4, where a sheet of support material 46 is moved into contact with the developed toner image via sheet feeding apparatus 48 in timed sequence so that the developed image on the photoconductive surface of belt 10 contacts the advancing sheet of support substrate 46 and is transferred thereto. In accordance with the present invention, a biased roll transfer system is provided for establishing an electrostatic directional force field capable of attracting toner particles from an image support surface, namely the photoconductive surface of belt 10, to support substrate 46. The details of the bias transfer roll will be discussed hereinbelow.

After the transfer process is complete, the support substrate 46 is transported to a fusing station (not shown) for permanently affixing the transferred image to the support substrate 46. After fusing, the sheet of support substrate material 46 is advanced to a receiving tray (not shown) for subsequent removal of the finished copy by an operator. Invariably, after the support substrate 46 is separated from belt 10, some residual developing material remains adhered to belt 10. Thus, a final processing station, namely a cleaning station (not shown), is also provided along the path of belt 10 for removing residual toner particles from the surface thereof, subsequent to separation of the support material 46 from belt 10 in preparation for a subsequent imaging cycle. It will be understood that variations of specific electrostatographic processing subsystems or processes may be expected without affecting the operation of the present invention.

The use of the term "bias transfer roll" or "biased roll transfer system", as used herein, refers to a transfer assembly having an electrically biased contact member or electrode for attracting electrically charged particles from an image support surface, such as a photoreceptor, onto a copy support substrate, such as a copy sheet or the like. Specifically, a biased roll transfer system including a bias transfer roll is shown in FIGS. 3 and 4, wherein the bias transfer roll 50 is illustrated in a configuration adapted to form a transfer nip for receiving a sheet of copy support substrate 46, allowing the copy support substrate 46 to cooperate with the toner image on belt 10 when brought into contact therewith. The bias transfer roll 50 electrostatically attracts charged toner particles from the photoconductive surface of belt 10 in the direction of the bias transfer roll 50 so as to transfer the developed image to the copy substrate 46, positioned therebetween.

For the purposes of the present discussion, a configuration is shown wherein the bias transfer roll 50 is urged physically against belt 10 and drive roller 22, forming a nip therebetween. In this configuration, the bias transfer roll 50 is caused to be slightly deformed at the nip, thereby increasing the contact dwell time between the belt 10 and the bias transfer roll 50. It will be understood, however, that the transfer station can be positioned upstream or downstream from drive roll 22. Alternatively, the bias transfer roll system can be incorporated into a machine having a rigid or drum-type photoreceptor member.

The bias transfer roll 50 is appropriately journaled for rotation at an angular velocity so that the peripheral speed of the transfer roll 50 is substantially equal to the speed of the belt 10. The arrows shown in FIGS. 3 and 4 indicate the relative direction of movement for the copy substrate 46, the transfer roll 50 and belt 10, as the copy support substrate 46 is fed into and through the nip formed between transfer roll 50 and belt 10. As such, the terms "pre-nip" and "post-nip" used herein refer to the direction of travel of the copy substrate 46 through the transfer nip.

The mechanical features of the particular transfer system depicted in FIGS. 3 and 4 are well known in the art. Briefly, copy substrate 46 is fed via a sheet feeder 48 into the transfer nip in registration with a toner image on the photoconductive surface of belt 10. Prior to reaching the nip region, the charge on the surface of the belt 10 may be altered by an appropriately biased corotron 14 and/or a pre-transfer lamp (not shown). The speed of the sheet through the nip is approximately 10–20 inches per second.

Electrical biasing source 59 is provided for generating current flow through the bias transfer roll 50. The biasing source 59, usually in the form of a constant current source, provides electrical potential for creating high transfer fields while maintaining pre-nip ionization at tolerable levels and allowing a desired amount of post-nip ionization. A discussion of the electric fields developed by the bias transfer roll 50 and the roles of the different materials making up the layers thereof, as well as a detailed description of a preferable circuit for the electrical biasing source 50 are provided in U.S. Pat. No. 3,781,105, issued to Meagher, the contents of which are hereby incorporated by reference.

In addition, a corotron 82, located in the post-nip area, commonly referred to as a detack corotron, is designed to neutralize or lower the potential of the charge deposited onto the sheet 46 by post-nip ionization in order to make the copy substrate 46 easier to strip from the belt 10. In this regard, the output of the constant current bias source 59 can be adjusted so that the tacking force of the charge on the non-image side of sheet 46 to the belt 10 is very limited. In other words, the bias current can be adjusted so that a detack corotron 82 is not necessary, although transfer efficiency may be hindered as a result. Copy substrate 46 is extracted from the transfer system and belt 10 by a vacuum belt transport 83 which includes a continuous belt 84 moving around roller 85 in the direction indicated. A vacuum chamber 86 is also provided for pulling the copy substrate 46 toward belt 84 to transport the sheet onward to the fusing station (not shown).

The exemplary transfer roll 50 of the present invention is shown in FIG. 1 and includes an electrically "self-leveling" layer 56, layered over an electrically "relaxable" layer 54, covering an electrically conductive central core or axle 52. The thicknesses of the various layers shown are provided for illustrative purposes only and are not necessarily drawn to scale. The biasing source 59 is electrically coupled to the conductive core 52 for providing an electrical bias to the bias transfer roll 50. A cleaning brush 80 and an associated vacuum housing 81 are positioned adjacent to the bias transfer roll 50 for cleaning stray toner particles as well as other contaminants from the surface of the roller 50. Alternatively, a vacuum cleaning system 80*a* generating significant airflow across the surface of the roll 50, as shown in FIG. 4, can be incorporated into the biased roll transfer system of the present invention to provide a non-contact cleaning mechanism. In accordance with the present invention, the exterior surface of the bias transfer roll is also treated or provided with an external coating for reducing the surface energy of the bias transfer roll 50 to enhance the cleanability thereof.

In a preferred embodiment, the relaxable layer 54 of the transfer roll 50 comprises a relatively thick layer of a resilient elastomeric polyurethane material which may include a butadiene based copolymer having a hardness of between about 40 Shore 00 and about 90 Shore A. This elastomeric polyurethane layer may be about 0.030 to about 0.625 inches in thickness (preferably 0.25 inches in thickness), and should have sufficient resiliency to allow the bias transfer roll 50 to become slightly deformed when brought into moving contact with an opposingly supported portion of belt 10. Other materials and configurations with appropriate hardnesses and dimensions are described by Dolcimascolo et al. (U.S. Pat. No. 3,702,482), Eddy et al. (U.S. Pat. No. 3,959,573), Seanor et al. (U.S. Pat. No. 3,959,574), Lutz et al. (U.S. Pat. Nos. 4,058,879 and 4,116,894) and Safford et al. (U.S. Pat. No. 4,062,812), among others. The references cited herein are specifically incorporated by reference for their teachings. The relative deformable characteristics of the relaxable layer 54, as well as the belt 10, preferably permit good mechanical contact in the transfer nip at moderate pressures to minimize or eliminate "hollow character" transfer under normal operating conditions. This deformable feature also provides an extended contact region for increasing the dwell time in which toner particles of the developer material can be transferred between support surfaces, as previously discussed. It will be understood that the deformable feature provided by relaxable layer 54 is not an absolutely necessary feature of the present invention, as for example in a configuration, as previously discussed, wherein transfer is conducted against an unsupported portion of belt 10.

The material making up the relaxable layer 54 is further selected for its functionality so that a selected time period is required to transmit a charge from the conductive core 52 to the interface between the relaxable layer 54 and the self-leveling layer 56. The relaxable layer 54 has a bulk resistivity falling within a well-defined operating range selected relative to the diameter of the transfer roll 50 as well as to the surface velocity thereof. The preferred resistivity ranges may vary for transfer systems designed to operate at different transfer sheet throughput speeds and is selected to correspond to the roller surface speed and nip region dimension such that the time necessary to transmit a charge from the conductive core 52 to the external surface of the bias transfer roll 50 is roughly greater than the dwell time for any point on the transfer roll 50 in the transfer nip region. Ideally, the external voltage profile of the bias transfer roll 50 provides a field strength below that which is necessary for substantial air ionization in the air gap at the entrance of the nip, and above that required for air ionization in the air gap just beyond the exit of the nip. As a general rule, the magnitude of the external electric field increases significantly from the pre-nip entrance toward the post-nip exit while the field within the relaxable layer 54 diminishes. It has been found that a resistivity of between about $10^7$ and $5.0\times10^{11}$ ohm-cm, and preferably a resistivity of about $10^8$ to about $10^{10}$ ohm-cm is sufficient for this requirement.

The relaxable layer 54 is enveloped by another layer, so called self-leveling layer 56, which may comprise an organic elastomeric material such as polyurethane, polyimide, rubber, etc., having a resistivity of between $10^{10}$ and $10^{15}$ ohm-cm, preferably having a thickness of approximately 0.0025 inches and a hardness of about 65 to 75 Durometer. Other materials having particular hardnesses and characteristics are described by Dolcimascolo et al. (U.S. Pat. No. 3,702,482), Eddy et al. (U.S. Pat. No. 3,959,573), Seanor et al. (U.S. Pat. No. 3,959,574), Lutz et al. (U.S. Pat. Nos. 4,058,879 and 4,116,894) and Safford et al. (U.S. Pat. No. 4,062,812), among others. The references cited herein are specifically incorporated by reference for their teachings. The material of the self-leveling layer is generally selected for its higher resistive values, providing a so-called leaky insulator. In addition, the self-leveling layer 56 includes material (or is so related to the relaxable layer) so that charges applied to the outer surface of the self-leveling layer 56 will be generally dissipated within one-revolution of the transfer roll 50 in order to prevent suppression of the transfer fields in the transfer nip. The self-leveling layer 56 also acts as a thin insulating layer to protect the bias transfer roll 50 during air breakdown and to limit current flow through the roll 50.

In accordance with the present invention, the peripheral surface of the bias transfer roll 50 is treated or coated to provide a low surface energy in order to enable nonresistant removal of residual toner particles or other contaminants from the surface thereof. This low surface energy feature can be provided by two methods: the material making up the outer layer of the bias transfer roll can be modified with respect to its chemical properties in a region bordering the periphery thereof; or an additional outer layer or film can be coated onto the bias transfer roll. Both methods will be discussed hereinbelow.

Chemical modification of a region bordering the periphery of the bias transfer roll 50 is the desirable method for providing low surface energy if the material making up the peripheral surface of the bias transfer roll is, in fact, capable of being chemically modified in a suitable manner. The preferred method of chemical modification for providing low surface energy is via surface fluorination, as for example, by exposing the bias transfer roll to a carbontetrafluoride ($CF_4$) plasma to modify the organic surface properties thereof. It will be understood that other ionization techniques may be used for achieving the desired chemical modification. The resultant structure is shown illustratively in FIG. 1 where a region adjacent the periphery of self-leveling layer 56 of the bias transfer roll is ionized with fluorine atoms. It is estimated that the fluorine atoms will modify the surface layer until surface saturation is reached, up to an approximate depth of 1,000 Å. Data was collected with respect to the surface energy of specific bias transfer roll samples using the ionization method disclosed herein via measurement of the contact angle with deionized (DI) water. This data showed an increase in the contact angle with DI water from the range of 85°-94° to approximately 107°-126°. This increase in contact angle represents a substantial decrease in surface energy.

Figure 2:
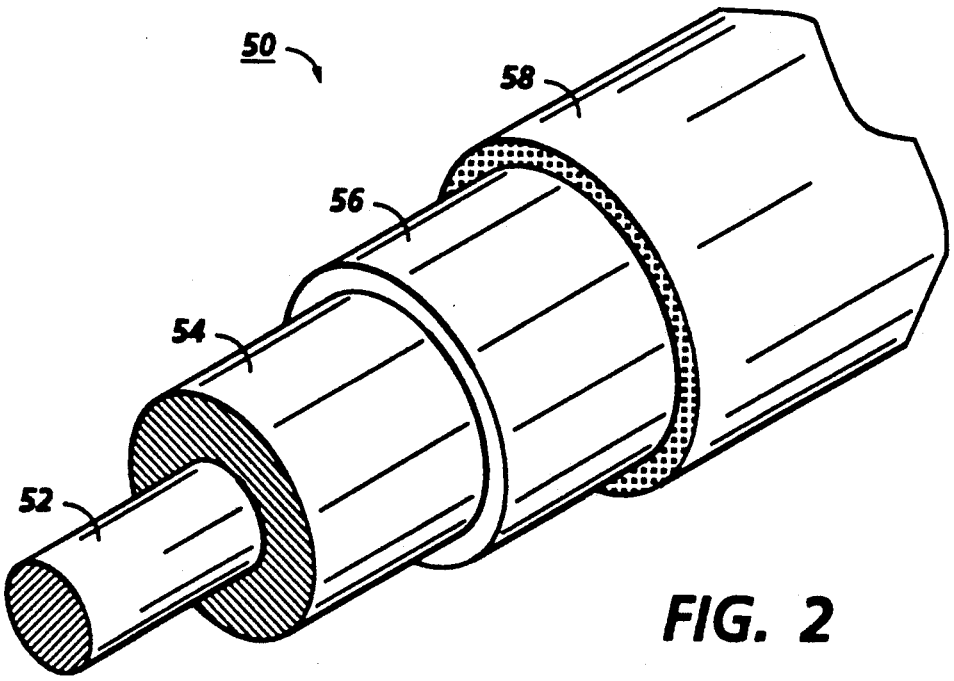
FIG. 2 is a perspective view in partial section showing the construction of another preferred embodiment of a bias transfer roll having a low surface energy outer layer in accordance with the present invention.

In a second method of practicing the present invention, it may be preferable to deposit a thin coating or film of some low surface energy material over the outer layer of bias transfer roll 50, thereby creating another layer 58 on the bias transfer roll 50, as illustrated in FIG. 2. The addition of a peripheral layer (as opposed to the surface modification method, previously discussed) requires particular attention to the thickness of the coating layer such that the conductivity of the bias transfer roll 50 is not adversely effected. In this embodiment of the invention, low surface energy layer 58 is limited to no greater than 500 Å, and preferably about 100 Å in thickness. Suitable materials for creating this low surface energy layer 58 include: polydimethylsiloxane solution; methoxy silane, polyimide siloxane; fluororesins; fluoropolymers and Teflon (available from E. I. DuPont de Nemours, Inc. of Wilmington, Del.). These materials are preferably provided in some type of soluble amorphous form for deposit on the bias roll structure via spinning, dipping, spraying, or plasma deposition.

With the above information, the significance of providing a low surface energy surface on a biasable transfer member as used in electrostatographic machines is better understood. Stated simply, the significance is that, as previously suggested, the external surface of the bias roll 50 is easier to clean with the low surface energy periphery of the present invention. Maintenance of a clean bias transfer roll surface eliminates contamination of the bias transfer roll and specious transfer of toner particles during the transfer process. Further, a clean bias transfer roll surface permits high transfer efficiency to be achieved with a relatively lower applied voltage and charge density on the transfer member. Moreover, since bias roll electrical life is a function of the applied field and therefore the voltage across the bias transfer roll, maintenance of a clean, contamination free surface extends the electrical life of the roll.

In recapitulation, the electrophotographic printing apparatus of the present invention includes a biased roll toner transfer system having a bias transfer roll including an external surface having a low surface energy on the transfer roll to enhance the cleanability of the bias transfer roll.

It is therefore evident that there has been provided, in accordance with the present invention, an electrophotographic printing apparatus and, more specifically, a biasable transfer member that fully satisfies the aims and advantages of the invention as hereinabove set forth. While this invention has been described in conjunction with preferred embodiments thereof, it is evident that many alternatives, modifications, and variations will be apparent to those skilled in the art. Accordingly, the present application for patent is intended to embrace all such alternatives, modifications and variations as are within the broad scope and spirit of the appended claims.

We claim:

1. A transfer member for transferring electrically charged particles from an image support surface to a substrate, comprising:

an electrically conductive core member; and a layer of resistive material covering said core member, said layer of resistive material including a chemically modified peripheral surface having a low surface energy material embedded therein to enhance removal of charged particles therefrom.

2. The transfer member of claim 1, wherein the chemically modified peripheral surface comprises a surface fluorination region embedded in said layer of resistive material.

3. The transfer member of claim 2, wherein the surface fluorination region includes fluorine atoms embedded in said layer of resistive material.

4. The transfer member of claim 1, wherein said low surface energy material is selected from the group consisting of polydimethylsiloxane solution, methoxy silane, polyimide siloxane, fluororesin, fluoropolymer and polytetrafluoroethylene.

5. The transfer member of claim 1, further comprising a second layer of resistive material located between said electrically conductive core member and said layer of resistive material.

6. A biased roll transfer system for transferring electrically charged particles from an image support surface to a substrate, comprising:

a transfer member including:

an electrically conductive core member;

a layer of resistive material covering said core member, wherein said layer of resistive material includes a chemically modified peripheral surface having a low surface energy material embedded therein so as to enhance removal of charged particles therefrom;

means, coupled to said electrically conductive core member, for applying an electrical bias thereto to generate electrical fields between said transfer member and the image support surface for attracting the charged particles from the image support surface to the copy substrate; and means for cleaning the peripheral surface of said transfer member.

7. The biased roll transfer system of claim 6, wherein said cleaning means includes a contact member for sweeping the peripheral surface of said transfer member.

8. The biased roll transfer system of claim 7, wherein said contact member includes a brush element.

9. The biased roll transfer system of claim 6, wherein said cleaning means includes a non-contact cleaning system for generating an airflow across said peripheral surface of said transfer member.

10. The biased roll transfer system of claim 6, wherein said biasing means includes a constant current source for providing a constant current through said transfer member to generate electric fields between said image support surface and said transfer member.

11. An electrostatographic printing machine, comprising:

a biased roll transfer system for transferring electrically charged particles from an image support surface to a copy substrate, comprising:

a transfer member including an electrically conductive core member;

a layer of resistive material coated on said core member, wherein said layer of resistive material includes a chemically modified peripheral surface having a sufficient low surface energy material embedded therein to enhance removal of charged particles therefrom;

means, coupled to said transfer member, for applying an electrical bias thereto to generate electrical fields between said transfer member and the image support surface, for attracting the charged particles from the image support surface to the copy substrate; and means for cleaning said transfer member.

* * * * *